US006968900B2

(12) United States Patent
Williams et al.

(10) Patent No.: US 6,968,900 B2
(45) Date of Patent: Nov. 29, 2005

(54) PORTABLE DRILL STRING COMPENSATOR

(75) Inventors: Richard D. Williams, Sugar Land, TX (US); Lacey C. Coffey, Houston, TX (US)

(73) Assignee: Control Flow Inc., Houston, TX (US)

( * ) Notice: Subject to any disclaimer, the term of this patent is extended or adjusted under 35 U.S.C. 154(b) by 255 days.

(21) Appl. No.: 10/314,747

(22) Filed: Dec. 9, 2002

(65) Prior Publication Data

US 2004/0108117 A1 Jun. 10, 2004

(51) Int. Cl.[7] ..... E21B 43/01
(52) U.S. Cl. ..... 166/355; 405/224.4; 405/224.3
(58) Field of Search ..... 166/355; 405/224.3, 405/224.4, 223.1, 224.1

(56) References Cited

U.S. PATENT DOCUMENTS

| | | | |
|---|---|---|---|
| 913,970 | A | 3/1909 | Parfitt |
| 3,208,728 | A | 9/1965 | Parks |
| 3,280,908 | A | 10/1966 | Todd |
| 3,313,345 | A | 4/1967 | Fischer |
| 3,643,751 | A | 2/1972 | Crickmer |
| 3,680,644 | A | 8/1972 | Doughty |
| 3,718,316 | A | 2/1973 | Larralde et al. |
| 3,793,835 | A | 2/1974 | Larralde |
| 3,804,183 | A | 4/1974 | Duncan et al. |
| 3,841,607 | A | 10/1974 | Larralde et al. |
| 3,897,045 | A | 7/1975 | Butler |
| 3,955,621 | A | 5/1976 | Webb |
| 4,004,532 | A | 1/1977 | Reynolds |
| 4,068,868 | A | 1/1978 | Ohrt |
| 4,075,858 | A | 2/1978 | Frederick |
| 4,176,722 | A | 12/1979 | Wetmore et al. |
| 4,215,950 | A | 8/1980 | Stevenson |
| 4,222,341 | A | 9/1980 | Larsen et al. |
| 4,272,059 | A | 6/1981 | Noerager et al. |
| 4,317,586 | A | 3/1982 | Campbell |
| 4,362,438 | A | 12/1982 | Spink |
| 4,367,981 | A | 1/1983 | Shapiro |
| 4,379,657 | A | 4/1983 | Widiner et al. |
| 4,421,173 | A | 12/1983 | Beakley et al. |
| 4,423,983 | A | 1/1984 | Dadiras et al. |
| 4,432,420 | A | 2/1984 | Gregory et al. |
| 4,449,854 | A | 5/1984 | Nayler |
| 4,473,323 | A | 9/1984 | Gregory |
| 4,479,550 | A | 10/1984 | Kühn et al. |
| 4,487,150 | A | 12/1984 | Shanks |

(Continued)

FOREIGN PATENT DOCUMENTS

| | | |
|---|---|---|
| GB | 2141470 A | 12/1984 |
| WO | WO 97/43516 | 11/1997 |
| WO | WO 00/24998 | 5/2000 |

*Primary Examiner*—David Bagnell
(74) *Attorney, Agent, or Firm*—Andrews Kurth LLP; Anthony F. Matheny

(57) ABSTRACT

A closed system drill string compensator having a hydraulic fluid accumulator, at least one air pressure vessel, and a piston and a piston rod slidably engaged within a cylinder. The drill string compensator provides tensioning force for supporting a drill string and permits the drilling vessel to remain connected to the drill string during ocean level changes caused by wave action or ocean heave. In one embodiment, the accumulator surrounds the cylinder and at least one air pressure vessel is radially disposed around the accumulator and the cylinder. In another embodiment, the accumulator surrounds the cylinder and includes two ports, one port for permitting fluid communication between the cylinder and the accumulator and a second port for permitting fluid communication between the accumulator and the air pressure vessel, the first port including a shut-off valve disposed therein. Methods of compensating a drill string are also disclosed.

17 Claims, 3 Drawing Sheets

U.S. PATENT DOCUMENTS 4,501,219 A 2/1985 Bates, Jr.
4,615,542 A 10/1986 Ideno et al.
4,638,978 A 1/1987 Jordan
4,712,620 A 12/1987 Lim et al.
4,787,778 A 11/1988 Myers et al.
4,799,827 A 1/1989 Jaqua
4,808,035 A 2/1989 Stanton et al.
4,883,387 A 11/1989 Myers et al.
4,884,642 A 12/1989 Fadeev et al.
4,886,397 A 12/1989 Cherbonnier
5,101,905 A 4/1992 Arlt et al.
5,169,265 A 12/1992 Butler et al.
5,183,121 A 2/1993 Koudelka
5,209,302 A 5/1993 Robichaux et al.
5,252,004 A 10/1993 Butler et al.
5,551,803 A 9/1996 Pallini, Jr. et al.
5,658,095 A 8/1997 Arlt et al.
5,667,022 A 9/1997 Güde
5,727,630 A 3/1998 Brammer
5,758,990 A 6/1998 Davies et al.
5,846,028 A 12/1998 Thory
5,951,061 A 9/1999 Arlt, III et al.
5,960,893 A 10/1999 Prokop et al.
6,073,706 A 6/2000 Niemi
6,170,317 B1 1/2001 Juuri et al.
6,296,232 B1 10/2001 Roodenburg
6,343,662 B2 2/2002 Byrt et al.
6,343,893 B1 2/2002 Gleditsch
6,419,277 B1 7/2002 Reynolds
6,431,284 B1 8/2002 Finn et al.
2002/0040798 A1 4/2002 Intonen et al.

PORTABLE DRILL STRING COMPENSATOR

BACKGROUND OF THE INVENTION

1. Field of the Invention

The invention is directed to drill string compensators, and in particular to portable drill string compensators for use in connection with off-shore drilling operations such as off-shore drilling vessels to permit vertical movement of the drill string in relation to ocean heave.

2. Description of Related Art

Drill string compensators are employed to compensate for vessel motion induced by wave action and heave. Drill string compensators are also utilized to maintain a variable tension to the drill string alleviating the potential for compression and in turn buckling or failure.

Historically, conventional drill string compensators have consisted of both single and dual cylinder assemblies with a chain fixed at one end of the cylinder and a movable chain sheave attached to the rod end of the cylinder as disclosed in U.S. Pat. No. 3,804,183. The assembly is then mounted in a position on the vessel to allow convenient routing of chain which is connected to a point at the fixed end and strung over the movable sheaves. In turn, the chain is routed via sheaves and connected to the drill string compensator via a support consisting of a hook which is connected to the end termination of the chain assembly.

The cylinders and the chain assemblies are disposed on a derrick disposed above the drill string. Also disposed on the derrick, or on deck space located remotely from the derrick, but in close proximity, is a hydro/pneumatic system consisting of high pressure air vessels. Pressure from the air pressure vessels ("APVs") forces the rod and in turn the rod end sheave to stroke out thereby tensioning the chain and in turn the drill string.

One drill string compensator typically used on a rig and is set to support a portion of th weight of the drill string. The remaining portion of the drill string weight provides the force necessary for penetration as the drill string is spun.

Normal operation of these conventional type drill string compensator systems have required high maintenance due to the constant motion producing wear and degradation of the chain members. In addition, available space for installation and, the structure necessary to support the units including weight and loads imposed, particularly in deep water applications where the tension necessary requires additional large drill strings poses difficult problems for system configurations for both new vessel designs and upgrading existing vessel designs.

Additionally, as disclosed in U.S. Pat. No. 3,793,835, in prior drill string compensators, a bank of remotely located, either along the derrick or on the deck of the vessel, hydraulic fluid accumulators and APVs are required. These hydraulic fluid accumulators and APVs require large amounts of deck space with heavy piping and large diameter hoses to provide the operating pressure to the drill string compensator. These hoses combined with the control lines create bulky, heavy hose bundles, thereby requiring additional space and adding additional weight to the drilling vessel. Therefore, the portability of these drill string compensators is severely limited.

Accordingly, prior to the development of the present invention, there has been no drill string compensators or methods of compensating a drill string, which: provide portability to the entire drill sting compensator system, including APVs and hydraulic fluid accumulators; reduce the weight of equipment necessary to operate the drill string compensators; reduce the amount of deck space required for the drill string compensators; provide a self-contained and compact drill string compensator; and are operable without the use of a separate derrick. Therefore, the art has sought a drill string compensator and a method of compensating a drill string, which: provide portability to the entire drill sting compensator system, including APVs and hydraulic fluid accumulators; reduce the weight of equipment necessary to operate the drill string compensators; reduce the amount of deck space required for the drill string compensators; provide a self-contained and compact drill string compensator; and are operable without the use of a separate derrick.

SUMMARY OF INVENTION

In accordance with the invention the foregoing advantages have been achieved through the present closed system drill string compensator comprising: a cylinder having a cylinder inner wall surface, a cylinder outer wall surface and a cylinder cavity; a piston; a piston rod having a first piston rod end and a second piston rod end, the first piston rod end being connected to the piston; the piston and the piston rod being slidably engaged within the cylinder cavity thereby dividing the cylinder cavity into a rod side cavity containing a first portion of hydraulic fluid under pressure disposed therein and a piston side cavity, the piston and the piston rod each having a retracted position and a plurality of extended positions; an accumulator surrounding the cylinder, the accumulator having a first accumulator inner wall surface, a second accumulator inner wall surface, an accumulator outer wall surface, and an accumulator cavity, the accumulator cavity being in fluid communication with the rod side cavity, the accumulator cavity containing a second portion of hydraulic fluid and a gas under pressure; the cylinder and accumulator having a first closed end and a second closed end, the first closed end having a first attachment member and the second closed end having a piston rod passageway through which the second piston rod end passes, the second piston rod end being connected to second attachment member; and at least one air pressure vessel radially disposed around the cylinder and the accumulator, each of the at least one air pressure vessel being in fluid communication with the accumulator cavity.

A further feature of the closed drill string compensator is that the cylinder outer wall surface and the first accumulator inner wall surface may be integral. Another feature of the closed drill string compensator is that the rod side cavity may be in fluid communication with the accumulator cavity through a first port. An additional feature of the closed drill string compensator is that the port may include a shut-off valve. Still another feature of the closed drill string compensator is that each of the at least one air pressure vessel may be in fluid communication with the accumulator cavity through a second port, and wherein the first port may be disposed in close proximity to the second end of the drill string compensator and the second port may be disposed in close proximity to the first end of the drill string compensator. A further feature of the closed drill string compensator is that the piston side cavity may be a vacuum. Another feature of the closed drill string compensator is that the second end may include a base having a lock bar assembly for securing the drill string compensator in the retracted position. An additional feature of the closed drill string compensator is that the second end attachment member may include a second end attachment member passageway disposed through at least a portion of the second end attachment member and the base may include a lock bar passageway disposed through at least a portion of the base, the second end attachment member passageway and the lock bar passageway being capable of being aligned with each other in the retracted position for receiving a lock bar through the second end attachment member passageway and the lock bar passageway for securing the drill string compensator in the retracted position. Still another feature of the closed drill string compensator is that the first end and the second end may be connected through a main frame assembly. A further feature of the closed drill string compensator is that the base may be connected to the main frame assembly. Another feature of the closed drill string compensator is that the cylinder and the accumulator may be concentric.

In accordance with the invention the foregoing advantages have also been achieved through the present closed system drill string compensator comprising: a cylinder having a cylinder inner wall surface, a cylinder outer wall surface and a cylinder cavity; a piston; a piston rod having a first piston rod end and a second piston rod end, the first piston rod end being connected to the piston; the piston and the piston rod being slidably engaged within the cylinder cavity thereby dividing the cylinder cavity into a rod side cavity containing a first portion of hydraulic fluid under pressure disposed therein and a piston side cavity, the piston and the piston rod each having a retracted position and a plurality of extended positions; an accumulator surrounding the cylinder, the accumulator having a first inner accumulator wall surface, a second inner accumulator wall surface, an outer accumulator wall surface, and an accumulator cavity, the accumulator cavity being in fluid communication with the rod side cavity through a first port, the first port having a shut-off valve disposed therein and the accumulator cavity containing a second portion of hydraulic fluid and a gas under pressure; the cylinder and accumulator having a first closed end and a second closed end, the first closed end having a first attachment member and the second closed end having a piston rod passageway through which the second piston rod end passes, the second piston rod end being connected to second attachment member; and at least one air pressure vessel, each of the at least one air pressure vessel being in fluid communication with the accumulator cavity through a second port, wherein the first port is disposed in close proximity to the second closed end and the second port is disposed in close proximity to the first closed end.

A further feature of the closed drill string compensator is that the second closed end may include a base having a lock bar assembly for securing the drill string compensator in the retracted position. Another feature of the closed drill string compensator is that the second end attachment member may include a second end attachment member passageway disposed through at least a portion of the second end attachment member and the base may include a lock bar passageway disposed therein, the second end attachment member passageway and the lock bar passageway being capable of being aligned with each other in the retracted position for receiving a lock bar through the second end attachment member passageway and the lock bar passageway for securing the drill string compensator in the retracted position. An additional feature of the closed drill string compensator is that the cylinder outer wall surface and the first accumulator inner wall surface may be integral. Still another feature of the closed drill string compensator is that the piston side cavity may be a vacuum.

In accordance with the invention the foregoing advantages have been achieved through the present method of compensating a drill string, the method comprising the steps of: providing a closed system drill string compensator having a cylinder having a cylinder inner wall surface, a cylinder outer wall surface and a cylinder cavity, a piston, a piston rod having a first piston rod end and a second piston rod end, the first piston rod end being connected to the piston, the piston and the piston rod being slidably engaged within the cylinder cavity thereby dividing the cylinder cavity into a rod side cavity having a first portion of hydraulic fluid under pressure disposed therein and a piston side cavity, the piston and the piston rod each having a retracted position and a plurality of extended positions, an accumulator surrounding the cylinder, the accumulator having a first accumulator inner wall surface, a second accumulator inner wall surface, an accumulator outer wall surface, and an accumulator cavity, the accumulator cavity being in fluid communication with the rod side cavity, the accumulator cavity containing a second portion of hydraulic fluid and a gas under pressure, the cylinder and accumulator having a first closed end and a second closed end, the first closed end having a first attachment member and the second closed end having a piston rod passageway through which the second piston rod end passes, the second piston rod end being connected to second attachment member, and at least one air pressure vessel radially disposed around the cylinder and the accumulator, each of the at least one air pressure vessel being in fluid communication with the accumulator cavity; filling the rod side cavity and a portion of the accumulator cavity with the first portion of hydraulic fluid and the second portion of hydraulic fluid in amounts sufficient to support the weight of the drill string and permit the drill string compensator to move from the retracted position to at least one of the plurality of extended positions and from the at least one of the plurality of extended positions to the retracted position; pressurizing each of the at least one air pressure vessels with a gas pressure sufficient to support the weight of the drill string and permit the drill string compensator to move from the retracted position to at least one of the plurality of extended positions and from the at least one of the plurality of extended positions to the retracted position; and inserting the drill string compensator in the drill string.

A further feature of the method of compensating a drill string is that the drill string compensator may be placed and maintained in the retracted position prior to being inserted in the drill string. Another feature of the method of compensating a drill string is that the drill string compensator may be maintained in the retracted position by actuating at least one lock bar through the second attachment member. An additional feature of the method of compensating a drill string is that the accumulator and the rod side cavity of the cylinder of the drill string compensator may be in fluid communication with each other through a first port, the first port having a shut-off valve disposed therein, and wherein the drill string compensator may be maintained in the retracted position by actuating the shut-off valve.

The drill string compensators and a methods of compensating a drill string have the advantages of: providing portability to the entire drill sting compensator system, including APVs and hydraulic fluid accumulators; reducing the weight of equipment necessary to operate the drill string compensators; reducing the amount of deck space required for the drill string compensators; providing a self-contained and compact drill string compensator; and being operable without the use of a separate derrick.

While the invention will be described in connection with the preferred embodiment, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION AND SPECIFIC EMBODIMENTS

In one aspect, the invention is directed to drill string compensators. Broadly, the drill string compensators include a piston and a piston rod slidably engaged within a cylinder, a hydraulic fluid accumulator, referred to herein as "accumulator," and at least one air pressure vessel. The piston rod exits the cylinder and is connected to the drill string. Piston and piston rod are permitted to slide along the inner wall of the cylinder, and piston rod is permitted to be exposed to the outside, or atmosphere, however, hydraulic fluid or gas is not permitted to pass to the atmosphere.

The cavities above and below the piston are closed off from each other and the atmosphere. The cavity below the piston is in fluid communication with the accumulator, but is otherwise closed off from the atmosphere. The air pressure vessel is in fluid communication with the accumulator, but is otherwise closed off from the atmosphere. "Atmosphere" as used herein is defined as the environment outside the cylinder, accumulator, and the air pressure vessel. Therefore, the drill string compensator is a "closed system."

Figure 1:
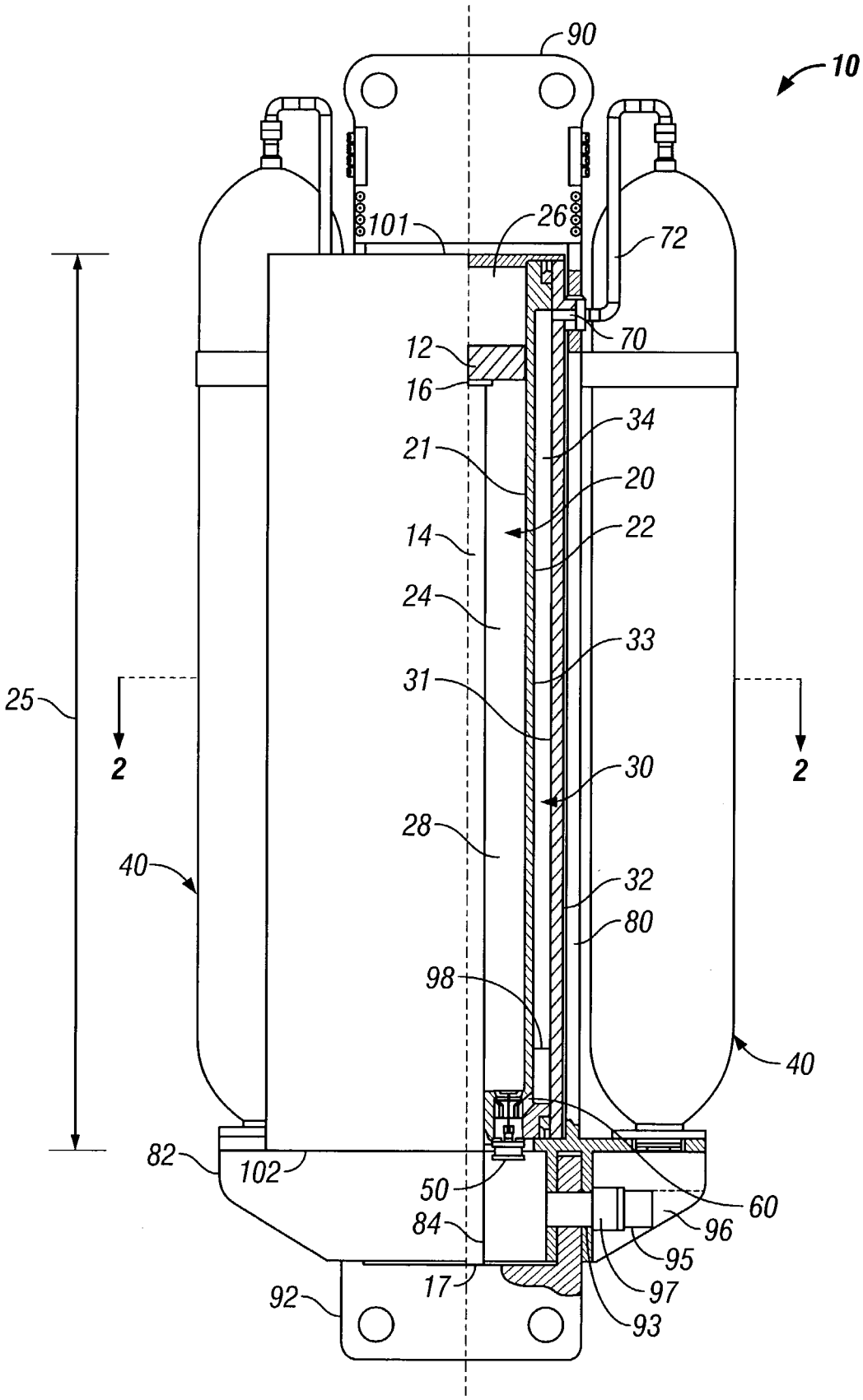
FIG. 1 is a cross-sectional view of one specific embodiment of the portable drill string compensator of the present invention in a retracted position.
Figure 2:
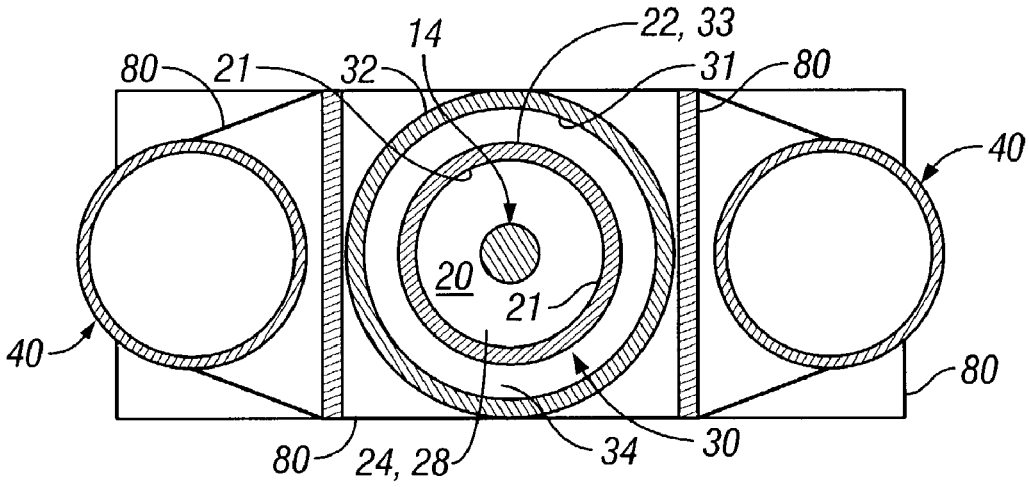
FIG. 2 is a cross-sectional view of the portable drill string compensator shown in FIG. 1 taken along line 2—2.
Figure 3:
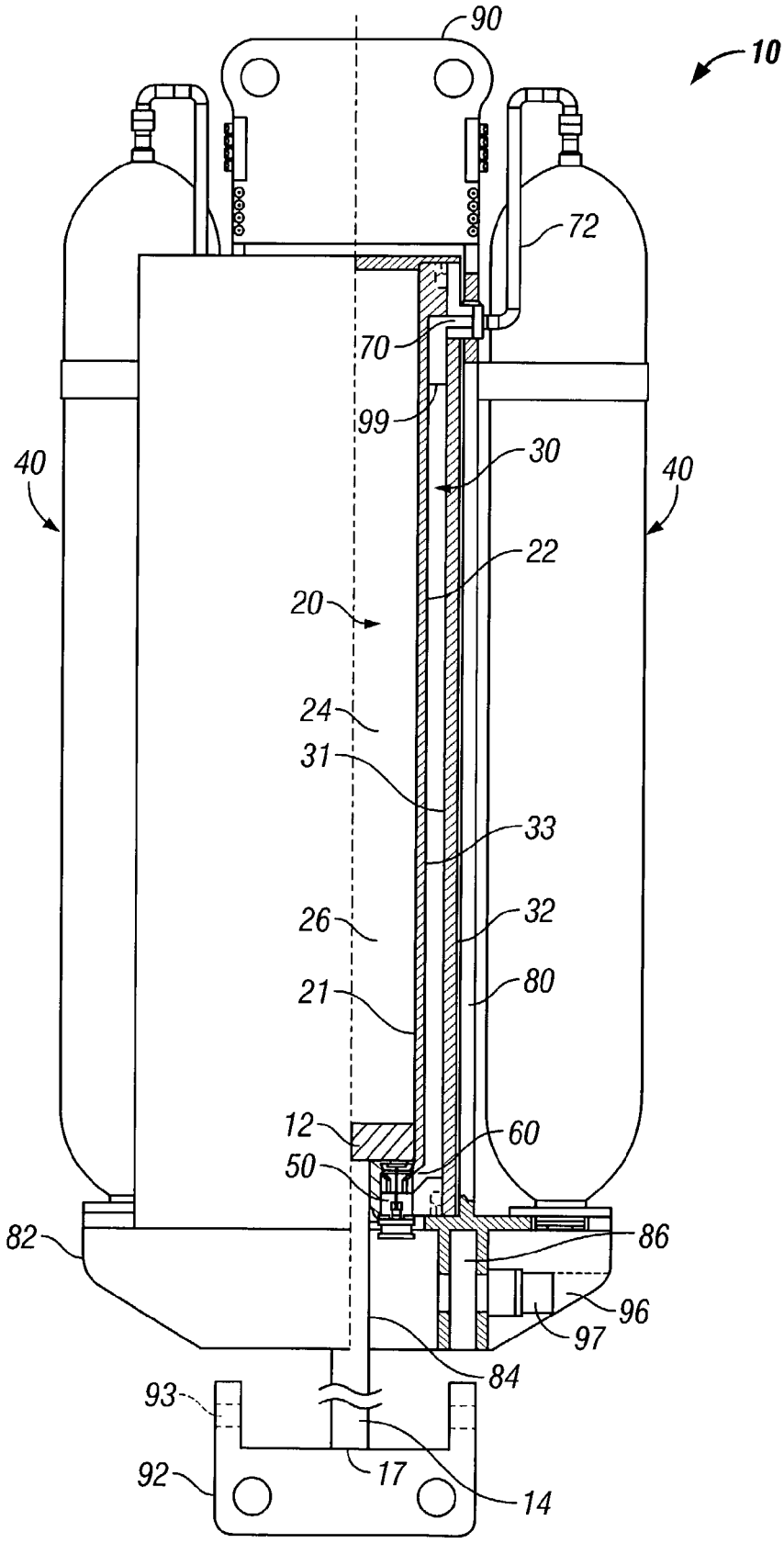
FIG. 3 is a cross-sectional view of the portable drill string compensator shown in FIG. 1 in an extended position.

Referring now to FIGS. 1–3, in one specific embodiment, drill string compensator 10 includes cylinder 20 and accumulator 30. Cylinder 20 and accumulator 30 include first closed end 101 and second closed end 102. First closed end 101 and second closed end 102 facilitate closing off cylinder 20 and accumulator 30, and thus drill string compensator 10, from atmosphere so that drill string compensator 10 is a closed system.

First closed end 101 includes first end attachment member 90 to facilitate connecting drill string compensator 10 to a drill string (not shown).

Cylinder 20 has cylinder inner wall surface 21, cylinder outer wall surface 22, and cylinder cavity 24. Piston 12 and piston rod 14 are slidably engaged within cylinder cavity 24 along inner wall surface 21, thereby dividing cylinder cavity 24 into piston side cavity 26 and rod side cavity 28. Piston 12 is designed such that it is slidably engaged with cylinder 20 by contacting cylinder inner wall surface 21 and preventing fluid communication between piston side cavity 26 and rod side cavity 28, yet piston 12 and piston rod 14 are permitted to move along length 25 of cylinder 20. Seals (not shown) disposed in or around piston 12 may be utilized to prevent fluid communication between piston side cavity 26 and rod side cavity 28.

Piston 12 and piston rod 14, and thus drill string compensator 10, have retracted position (FIG. 1) and a plurality of extended positions, one of the plurality of extended positions being a fully extended position (FIG. 3). As is apparent to persons of ordinary skill in the art, the fully extended position will be based upon the length of piston rod 14.

Piston rod 14 includes first piston rod end 16 and second piston rod end 17. First piston rod end 16 is connected to piston 12 and second piston rod end 17 is connected to second end attachment member 92 through piston rod passageway disposed through second closed end 102 as discussed in greater detail below. Second end attachment member 92 facilitates connecting drill string compensator 10 to a drill string, such that either the first end attachment member 90 or the second end attachment member 92 may be attached to the drill string while the other of the first end attachment member 90 or second end attachment member 92 is attached to a separate structure.

In one specific embodiment, drill string compensator 10 includes main frame 80 and base 82 disposed along second closed end 102 to provide support to cylinder 20, accumulator 30, and air pressure vessel 40. Second closed end 102 and base 82 includes piston rod passageway 84 through which rod 14 is permitted to pass to connect to second end attachment member 92. Piston rod passageway 84 is designed to prevent fluid communication between rod side cavity 28 and the outside of drill string compensator 10, i.e., atmosphere. Seals (not shown) disposed in or around piston rod 14, or within second closed end 102 or within base 82 along piston rode passageway 84, may be utilized to prevent fluid communication between rod side cavity 28 and the atmosphere. Therefore, drill string compensator 10 provides a closed system, i.e., not open to the atmosphere.

In another specific embodiment, base 82 includes lock bar assembly 95 having lock bar 97 and lock bar passageway 96 disposed through a portion of base 82. Base 82 also includes second end attachment member recess 86 for receiving a portion of second end attachment member 92. In this embodiment, second end attachment member 92 includes second end attachment member passageway 93 such that when piston rod 14 is placed is a certain position a portion of second end attachment member 92 is disposed within second end attachment member recess 86 such that lock bar passageway 96 and second end attachment member passageway 93 are aligned. Therefore, lock bar 97 is permitted to be actuated within lock bar passageway 96 and second end attachment member passageway 93 to facilitate securing second end attachment member 92 to base 82, and thus piston 12 and piston rod 14, and thus drill string compensator 10, in a desired position, e.g., retracted position shown in FIG. 1.

Accumulator 30 includes first accumulator inner wall surface 31, second accumulator inner wall surface 33, accumulator outer wall surface 32, and accumulator cavity 34. As shown in FIGS. 1–3, second accumulator inner wall surface 33 and cylinder outer wall surface 22 are integral, i.e., the same wall surface. Additionally, as shown in FIGS. 1–3, in a one specific embodiment, accumulator 30 is concentrically disposed around cylinder 20.

Accumulator cavity 34 is in fluid communication with rod side cavity 28 through port 60. Port 60 preferably includes shut-off valve 50 for facilitating regulation of the movement of hydraulic fluid or gas from rod side cavity 28 to accumulator cavity 34, and vice versa. For example, an operator of drill string compensator 10 may place drill string compensator 10 in a desired position, e.g., one of the plurality of extended positions, and shut-off valve 50 may be closed, thereby preventing movement of piston 12 and piston rod 14, and thus drill string compensator 10, to any of the other plurality of extended positions or to the retracted position.

Accumulator cavity 34 is also in fluid communication with at least one air pressure vessel 40 through port 70. While air pressure vessel 40 refers to "air," it is to be understood that any gas, e.g., atmospheric air and nitrogen, as desired or necessary depending on operating conditions, e.g., severe cold, heat, or pressures, may be contained within air pressure vessel 40.

Each of the at least one air pressure vessels 40 are preferably radially disposed around cylinder 20 and accumulator 30. As shown in FIGS. 1–3, two air pressure vessels 40 are disposed radially around cylinder 20 and accumulator 30. Additionally, port 60 is preferably disposed in close proximity to second closed end 102 and port 70 is preferably disposed in close proximity to first closed end 101. Further, as shown if FIGS. 1 and 3, each air pressure vessel 40 preferably includes air transfer tubing 72 for maintaining air pressure vessel 40 in fluid communication with accumulator 30.

As is readily understood by persons of ordinary skill in the art, when piston 12 and piston rod 14 are in the retracted position (FIG. 1), and thus, drill string compensator 10 is in the retracted position, the majority of hydraulic fluid (not shown) in the closed system drill string compensator 10 is disposed within rod side cavity 28 and the air, or other gas, in the closed system drill string compensator 10 is disposed within the majority of the volume of accumulator cavity 34. While it is to be understood that the level of hydraulic fluid remaining in accumulator 30 may vary among the various embodiments of drill string compensator 10, the level of hydraulic fluid remaining within accumulator cavity 34 when drill string compensator 10 is in the retracted position is at a level such that air or other gas is prevented from entering port 60, and thus, rod side cavity 28. An example of the level of hydraulic fluid is illustrated in FIG. 1 by line 98 in which air is disposed above line 98 and hydraulic fluid is disposed below line 98.

Additionally, as piston 12 and piston rod 14 are moved to the plurality of extended positions (FIG. 3), and thus, drill string compensator 10 is moved to the plurality of extended positions, hydraulic fluid is transported out of rod side cavity 28, through port 60, and into accumulator cavity 34. In so doing, the air previously disposed in accumulator cavity 34 is transported out of accumulator cavity 34, through port 70, and into air pressure vessel 40. When piston 12 and piston rod 14 reach the fully extended position, and thus drill string compensator 10 reaches the fully extended position (FIG. 3), the majority of hydraulic fluid in the closed system drill string compensator 10 is disposed within accumulator cavity 34. Sufficient air or other gas remains in accumulator cavity 34 at a level such that hydraulic fluid is prevented from entering port 70 and into air pressure vessel 40. An example of the level of hydraulic fluid is illustrated in FIG. 3 by line 99 in which air is disposed above line 99 and hydraulic fluid is disposed below line 99.

In moving drill string compensator 10 form the fully extended position (FIG. 3) to the retracted position (FIG. 1), hydraulic fluid is transported out of accumulator 30, through port 60, and into rod side cavity 28 while air or other gas is transported from air pressure vessel 40, through port 70, and into accumulator 30.

In another aspect, the invention is directed to methods of compensating a drill string. Broadly, the methods comprise the steps of providing one or more of the embodiments of drill string compensator 10 discussed above. Rod side cavity 28 and a portion of accumulator cavity 34 are then filled with portions of hydraulic fluid (not shown) in amounts sufficient to support the weight of the drill string and permit drill string compensator 10 to move from the retracted position to at least one of the plurality of extended positions, and from the at least one of the plurality of extended positions to the retracted position. Each of the air pressure vessel 40 is pressurized with a gas pressure sufficient to support the weight of the drill string and permit drill string compensator 10 to move from the retracted position to at least one of the plurality of extended positions and from the at least one of the plurality of extended positions to the retracted position. Persons of ordinary skill in the art can easily determine the amounts of hydraulic fluid and gas pressure based upon the size of drill string compensator 10 and the weight of the drill string.

After the hydraulic fluid is disposed within drill string compensator 10 and air pressure vessel 40 is pressurized with air, drill string compensator 10 is then inserted into the drill string. Preferably, drill string compensator 10 is placed and maintained in the retracted position prior to being inserted in the drill string. In so doing, lock bar 97 in drill string compensator 10 may be actuated to maintain drill string compensator 10 in the retracted position. Alternatively, shut-off valve 50 maybe actuated to maintain drill string compensator 10 in the retracted position. It is to be understood, however, that drill string compensator 10 may be placed in any position desired or necessary due to available room constraints to maneuver drill string compensator 10 into place, prior to inserting drill string compensator 10 into the drill string by actuating lock bar 97 or shut-off valve 50.

It is to be understood that the invention is not limited to the exact details of construction, operation, exact materials, or embodiments shown and described, as obvious modifications and equivalents will be apparent to one skilled in the art. For example, additional air pressure vessels may be disposed radially around the cylinder, thereby increasing the maximum load that the drill string compensator can support. Moreover, additional air pressure vessels in fluid communication with air pressure vessel 40 may be located remotely from drill string compensator 10, thereby increasing the maximum load that the drill string compensator can support. Additionally, the drill string compensator may not include a base. Therefore, second closed end includes the piston rod passageway through which the piston rod passes to connect to the second attachment member. As such, seals may be utilized around the piston rod or within second closed end along the piston rod passageway to prevent fluid communication between the rod side cavity and the atmosphere. Accordingly, the invention is therefore to be limited only by the scope of the appended claims.

What is claimed:

1. A closed system drill string compensator comprising:

a cylinder having a cylinder inner wall surface, a cylinder outer wall surface and a cylinder cavity;

a piston;

a piston rod having a first piston rod end and a second piston rod end, the first piston rod end being connected to the piston;

the piston and the piston rod being slidably engaged within the cylinder cavity thereby dividing the cylinder cavity into a rod side cavity containing a first portion of hydraulic fluid under pressure disposed therein and a piston side cavity, the piston and the piston rod each having a retracted position and a plurality of extended positions;

an accumulator surrounding the cylinder, the accumulator having a first accumulator inner wall surface, a second accumulator inner wall surface, an accumulator outer wall surface, and an accumulator cavity, the accumulator cavity being in fluid communication with the rod side cavity, the accumulator cavity containing a second portion of hydraulic fluid and a gas under pressure;

the cylinder and accumulator having a first closed end and a second closed end, the first closed end having a first attachment member and the second closed end having a piston rod passageway through which the second piston rod end passes, the second piston rod end being connected to second attachment member, and wherein the second closed end includes a base having a lock bar assembly for securing the drill string compensator in the retracted position; and at least one air pressure vessel radially disposed around the cylinder and the accumulator, each of the at least one air pressure vessel being in fluid communication with the accumulator cavity.

2. The closed system drill string compensator of claim 1, wherein the rod side cavity is in fluid communication with the accumulator cavity through a first port.

3. The closed system drill string compensator of claim 2, wherein the port includes a shut-off valve.

4. The closed system drill string compensator of claim 3, wherein the cylinder outer wall surface and the first accumulator inner wall surface are integral.

5. The closed system drill string compensator of claim 4, wherein the piston side cavity is a vacuum.

6. The closed system drill string compensator of claim 2, wherein each of the at least one air pressure vessel is in fluid communication with the accumulator cavity through a second port, and wherein the first port is disposed in close proximity to the second end of the drill string compensator and the second port is disposed in close proximity to the first end of the drill string compensator.

7. The closed system drill string compensator of claim 1, wherein the second end attachment member includes a second end attachment member passageway disposed through at least a portion of the second end attachment member and the base includes a lock bar passageway disposed through at least a portion of the base, the second end attachment member passageway and the lock bar passageway being capable of being aligned with each other in the retracted position for receiving a lock bar through the second end attachment member passageway and the lock bar passageway for securing the drill string compensator in the retracted position.

8. The closed system drill string compensator of claim 7, wherein the first end and the second end are connected through a main frame assembly.

9. The closed system drill string compensator of claim 8, wherein the base is connected to the main frame assembly.

10. The closed system drill string compensator of claim 9, wherein the cylinder and the accumulator are concentric.

11. A closed system drill string compensator comprising:

a cylinder having a cylinder inner wall surface, a cylinder outer wall surface and a cylinder cavity;

a piston;

a piston rod having a first piston rod end and a second piston rod end, the first piston rod end being connected to the piston;

the piston and the piston rod being slidably engaged within the cylinder cavity thereby dividing the cylinder cavity into a rod side cavity containing a first portion of hydraulic fluid under pressure disposed therein and a piston side cavity, the piston and the piston rod each having a retracted position and a plurality of extended positions;

an accumulator surrounding the cylinder, the accumulator having a first inner accumulator wall surface, a second inner accumulator wall surface, an outer accumulator wall surface, and an accumulator cavity, the accumulator cavity being in fluid communication with the rod side cavity through a first port, the first port having a shut-off valve disposed therein and the accumulator cavity containing a second portion of hydraulic fluid and a gas under pressure;

the cylinder and accumulator having a first closed end and a second closed end, the first closed end having a first attachment member and the second closed end having a piston rod passageway through which the second piston rod end passes, the second piston rod end being connected to second attachment member, and wherein the second closed end includes a base having a lock bar assembly for securing the drill string compensator in the retracted position; and at least one air pressure vessel, each of the at least one air pressure vessel being in fluid communication with the accumulator cavity through a second port, wherein the first port is disposed in close proximity to the second closed end and the second port is disposed in close proximity to the first closed end.

12. The closed system drill string compensator of claim 11, wherein the second end attachment member includes a second end attachment member passageway disposed through at least a portion of the second end attachment member and the base includes a lock bar passageway disposed through at least a portion of the base, the second end attachment member passageway and the lock bar passageway being capable of being aligned with each other in the retracted position for receiving a lock bar through the second end attachment member passageway and the lock bar passageway for securing the drill string compensator in the retracted position.

13. The closed system drill string compensator of claim 12, wherein the cylinder outer wall surface and the first accumulator inner wall surface are integral.

14. The closed system drill string compensator of claim 13, wherein the piston side cavity is a vacuum.

15. A method of compensating a drill string, the method comprising the steps of:

providing a closed system drill string compensator having a cylinder having a cylinder inner wall surface, a cylinder outer wall surface and a cylinder cavity, a piston, a piston rod having a first piston rod end and a second piston rod end, the first piston rod end being connected to the piston, the piston and the piston rod being slidably engaged within the cylinder cavity thereby dividing the cylinder cavity into a rod side cavity containing a first portion of hydraulic fluid under pressure disposed therein and a piston side cavity, the piston and the piston rod each having a retracted position and a plurality of extended positions, an accumulator surrounding the cylinder, the accumulator having a first accumulator inner wall surface, a second accumulator inner wall surface, an accumulator outer wall surface, and an accumulator cavity, the accumulator cavity being in fluid communication with the rod side cavity, the accumulator cavity containing a second portion of hydraulic fluid and a gas under pressure, the cylinder and accumulator having a first closed end and a second closed end, the first closed end having a first attachment member and the second closed end having a piston rod passageway through which the second piston rod end passes, the second piston rod end being connected to second attachment member, and at least one air pressure vessel radially disposed around the cylinder and the accumulator, each of the at least one air pressure vessel being in fluid communication with the accumulator cavity;

filling the rod side cavity and a portion of the accumulator cavity with the first portion of hydraulic fluid and the second portion of hydraulic fluid in amounts sufficient to support the weight of the drill string and permit the drill string compensator to move from the retracted position to at least one of the plurality of extended positions and from the at least one of the plurality of extended positions to the retracted position;

pressurizing each of the at least one air pressure vessels with a gas pressure sufficient to support the weight of the drill string and permit the drill string compensator to move from the retracted position to the at least one of the plurality of extended positions and from the at least one of the plurality of extended positions to the retracted position; and inserting the drill string compensator in the drill string, wherein the drill string compensator is placed and maintained in the retracted position prior to being inserted in the drill string.

16. The method of claim 15, wherein the drill string compensator is maintained in the retracted position by actuating at least one lock bar through the second attachment member.

17. The method of claim 16, wherein the accumulator and the rod side cavity of the cylinder of the drill string compensator are in fluid communication with each other through a first port, the first port having a shut-off valve disposed therein, and wherein the drill string compensator is maintained in the retracted position by actuating the shut-off valve.

* * * * *